United States Patent [19]

Miller et al.

[11] 4,397,509

[45] Aug. 9, 1983

[54] ARCADE GAME HOUSING

[75] Inventors: Anthony J. Miller, Skokie; Brian L. Poklacki, Chicago, both of Ill.

[73] Assignee: Universal Research Laboratories, Incorporated, Elk Grove Village, Ill.

[21] Appl. No.: 247,729

[22] Filed: Mar. 26, 1981

[51] Int. Cl.[3] ..... A47B 63/00; E05B 65/46

[52] U.S. Cl. ..... 312/320; 312/217; 312/223; 312/311

[58] Field of Search ..... 312/320, 223, 311, 217, 312/220, 221, 222, 35, 204; 211/26; 248/551, 552, 553; 194/1 A

[56] References Cited

U.S. PATENT DOCUMENTS

| | | | |
|---|---|---|---|
| 965,253 | 7/1910 | Tate | 312/217 |
| 1,750,291 | 3/1930 | Whetstone | 312/311 |
| 1,754,527 | 4/1930 | Rowe . | |
| 2,608,305 | 8/1952 | Sager | 312/311 |
| 2,660,506 | 11/1953 | Wright | 312/311 |
| 2,951,185 | 8/1960 | Buck | 312/320 |
| 3,135,570 | 6/1964 | Erismann | 312/311 |
| 3,137,533 | 6/1964 | Acker | 312/35 |
| 3,998,508 | 12/1976 | Scheerhorn | 312/217 |
| 4,002,381 | 1/1977 | Wagner et al. | 312/320 |
| 4,175,672 | 11/1979 | Moser . | |
| 4,209,211 | 6/1980 | Alford | 312/35 |
| 4,245,871 | 1/1981 | Rex | 312/223 |

FOREIGN PATENT DOCUMENTS

| | | | |
|---|---|---|---|
| 699842 | 11/1953 | United Kingdom | 312/217 |

OTHER PUBLICATIONS

Defensive Publication T174767, vol. 671, O.G. 1498, Jun. 30, 1953.

*Primary Examiner*—Victor N. Sakran

*Attorney, Agent, or Firm*—George H. Gerstman

[57] ABSTRACT

An arcade game in which the housing defines an opening on the front portion of the housing. A sliding panel which carries electronic circuitry is slid into and out of the housing, through the opening, along tracks. The front of the housing has a door for covering the opening, but this door is normally locked and can be unlocked only from inside the housing. To obtain access to unlock the door, the coin box closure on the front of the housing must be unlocked, enabling the operator to extend his hand into the interior of the housing to unlock the door.

13 Claims, 9 Drawing Figures

FIG. 1
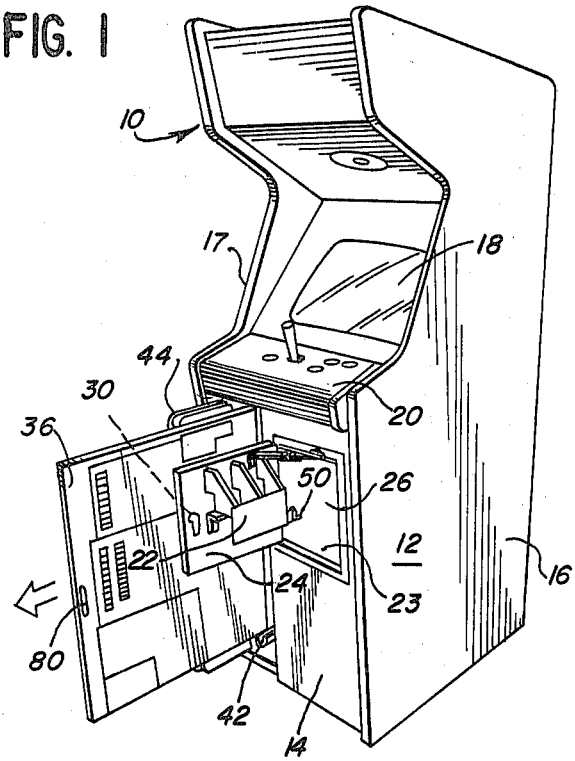
FIG. 2
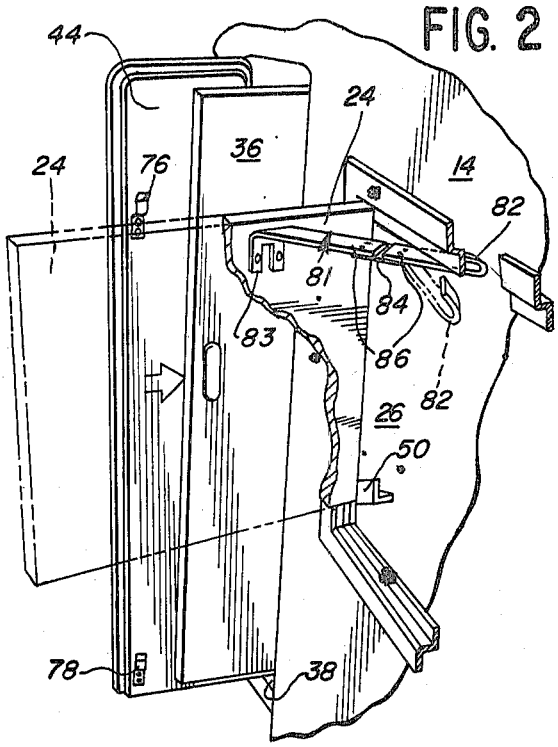
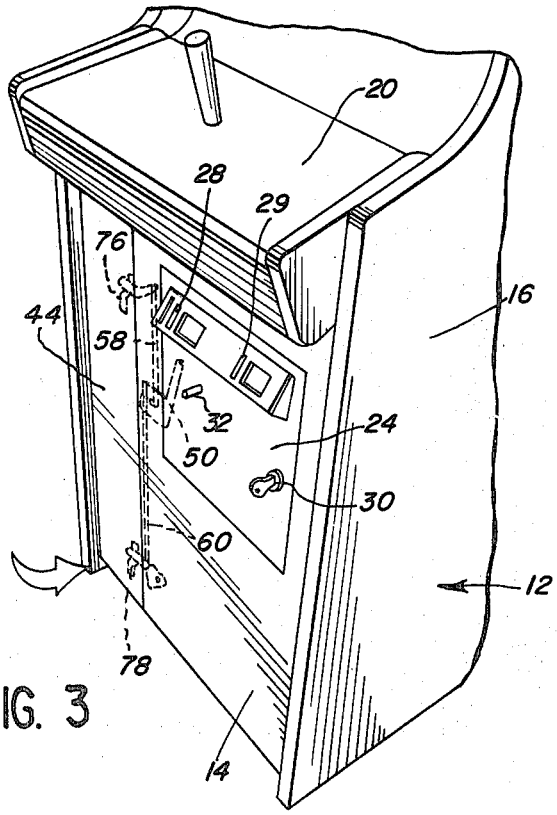
FIG. 3
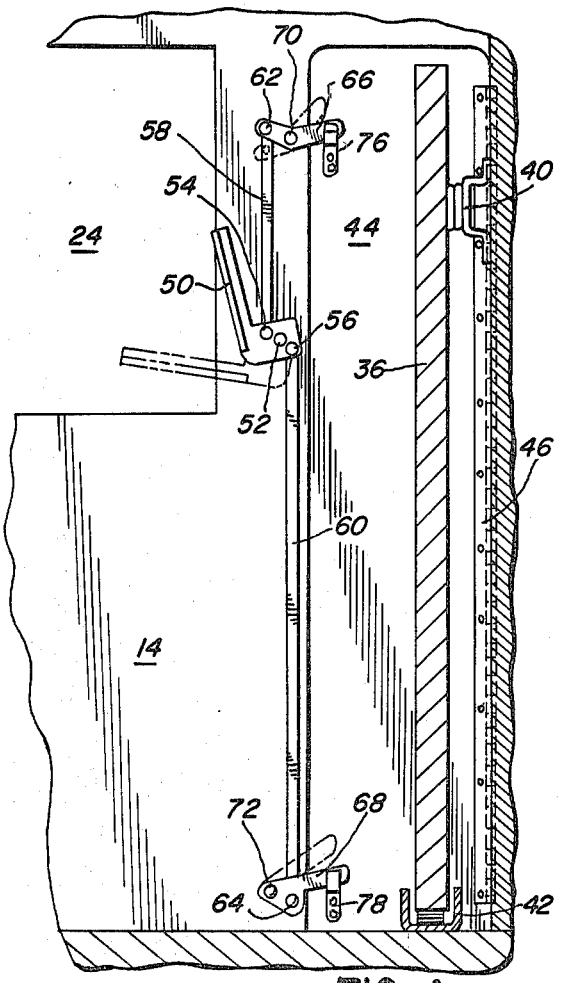
FIG. 4

FIG. 5
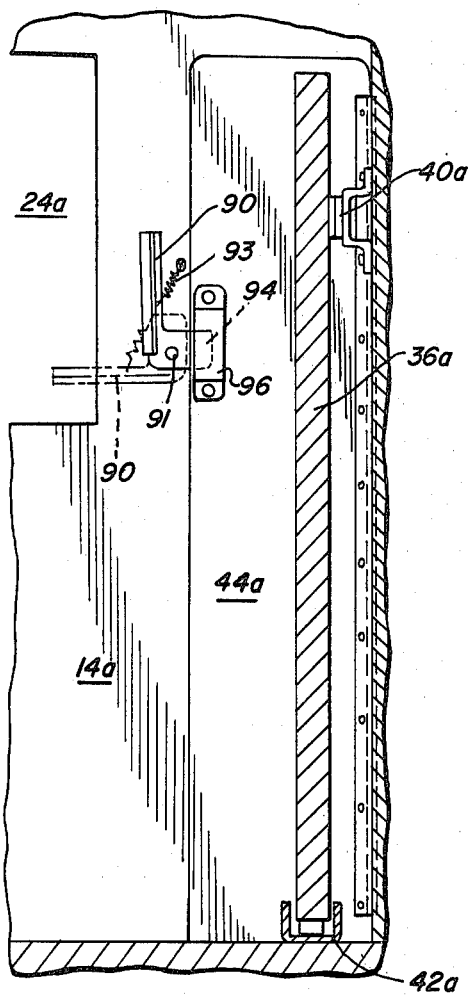
FIG. 6
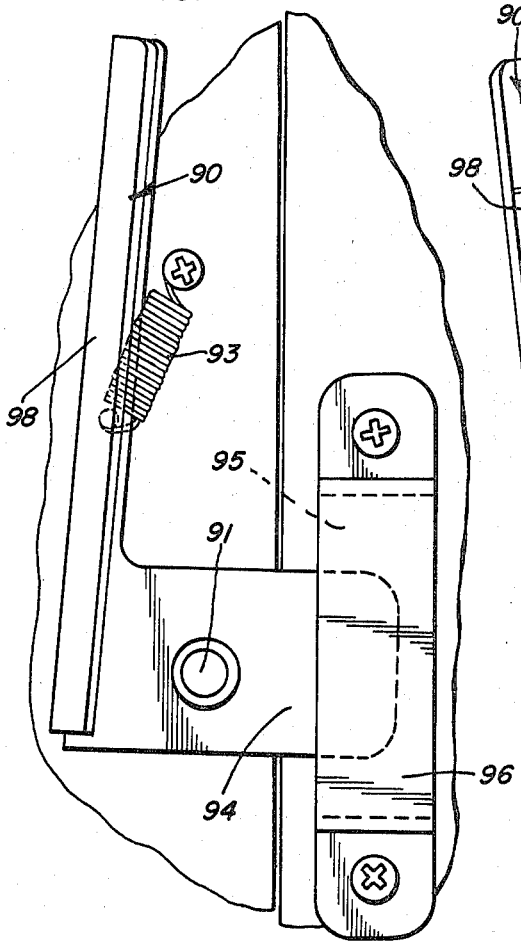
FIG. 7
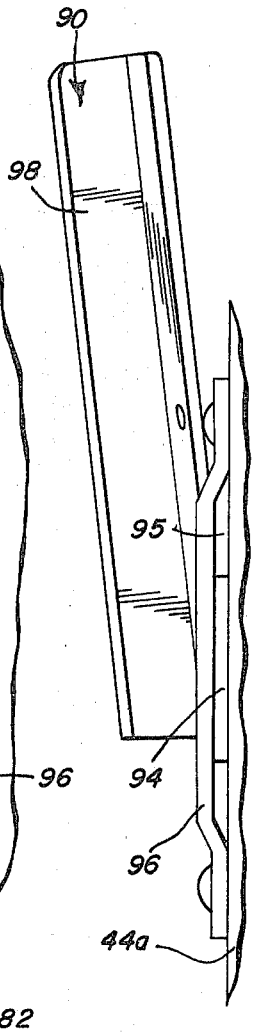
FIG. 8
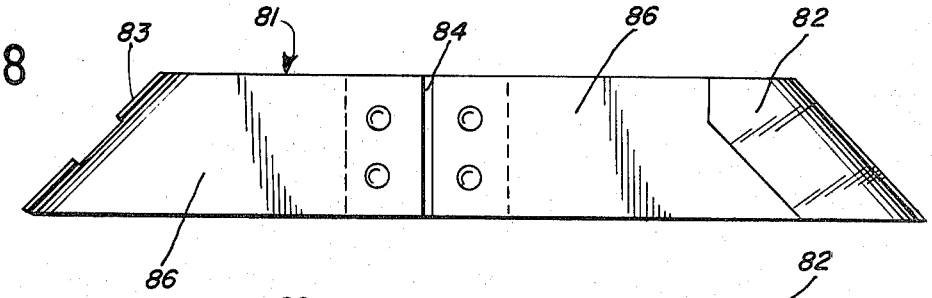
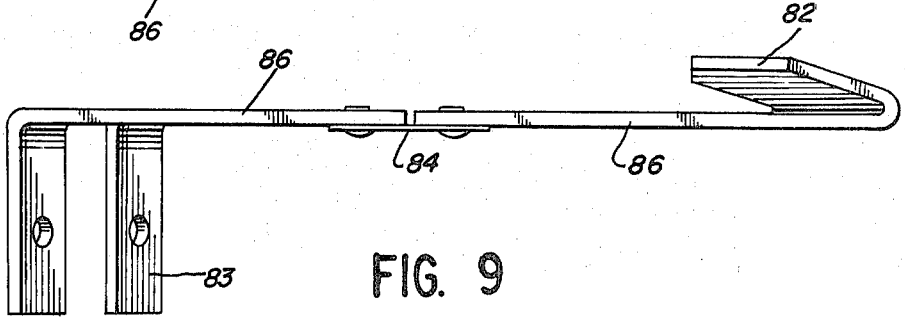
FIG. 9

ARCADE GAME HOUSING

BACKGROUND OF THE INVENTION

The present invention concerns an improved arcade game housing, in which the electronic circuitry is secure from tampering but is easily accessible for maintenance.

Typically arcade games, for example, coin-operated video games, comprise an upright housing carrying a control panel, with the upright housing enclosing electronic circuitry for the game. Typically the housing has a rear side that faces a wall once the game is installed and in position for being played. If maintenance or repair to the electronic circuitry is desired, it is necessary to move the arcade game away from the wall and then to remove the back panel of the housing.

Often arcade games weigh more than 200 pounds and are located in a relatively tight space. Under such conditions, it is extremely difficult and bothersome to have to pull the arcade game away from the wall and turn it into a position so that maintenance or repair to the electronic circuitry can be achieved.

It is an object of the present invention to provide an arcade game that is structured to enable easy access to the internal electronic circuitry by an authorized person.

Another object of the present invention is to provide an arcade game that is structured to prevent unauthorized persons from tampering with the internal electronic circuitry.

A further object of the invention is to provide an arcade game having structure that avoids the requirement that the arcade game be moved away from a wall in order to be serviced.

A still further object of the invention is to provide an arcade game that has an extraordinarily serviceable housing, yet is simple in construction and relatively easy to manufacture.

Other objects and advantages of the present invention will become apparent as the description proceeds.

BRIEF DESCRIPTION OF THE INVENTION

In accordance with the present invention, an arcade game is provided having an upright housing carrying a control panel. The upright housing encloses electronic circuitry for the game and has a rear side that typically faces a wall when the game is installed and played.

The improvement comprises the upright housing defining an opening on a portion thereof other than its rear side. A sliding panel carries the electronic circuitry and means are provided for connecting the sliding panel for sliding cooperation with the upright housing. In this manner, the sliding panel extends outside of the housing in an access position and the panel is slid into the housing in a normal game-play position.

A door is provided for covering the opening. Means are provided for connecting the door to the housing and permitting the door to be located in an open position when the panel is in the access position, and permitting the door to be located in a closed position, covering the opening, when the panel is in the normal game-play position.

In the illustrative embodiment, coin-receiving means are carried by the housing. The housing defines an access opening for the coin-receiving means. A closure is provided for covering the access opening and means are provided for locking the closure closed to prevent access to the coin-receiving means.

The housing includes means for locking the door, with the door locking means being inaccessible when the coin-receiving means closure is locked closed.

In the illustrative embodiment, the opening is defined on the front side of the upright housing, and the connecting means for the sliding panel comprise a pair of opposed, fixed tracks extending into the housing for enabling the sliding panel to slide along the fixed tracks into and out of the housing. The sliding panel has grasping means for enabling simple manual grasping of the panel, and the panel is in a form that is generally planar and extends generally perpendicular to the front of the housing.

The closure may comprise a hinged door member having a lock. To prevent the closure from striking the sliding panel in the access position, the closure may carry a projecting arm having a hook member at the free end to engage an inner surface of said upright housing, to limit the angular extent of opening of the closure.

The projecting arm may have a flexible portion positioned between its ends, to permits one to manually disengage the hook member from the inner surface of the housing when it is desired to open the closure to a full extent.

A more detailed explanation of the invention is provided in the following description and claims, and is illustrated in the accompanying drawings.

BRIEF DESCRIPTION OF THE DRAWINGS

FIG. 1 is a perspective view of an arcade game constructed in accordance with the principles of the present invention, showing the sliding panel in its access position;

FIG. 2 is an enlarged fragmentary view of a front portion of the housing of the arcade game of FIG. 1, showing the panel partially slid into the opening defined by the front portion, FIG. 3 is a fragmentary perspective view of the front of the housing of the arcade game of FIG. 1, with the coin-receiving means closure and the door shown in their closed position;

FIG. 4 is a view from the inside of the housing of the arcade game of FIG. 3, showing a locking system for the door;

FIG. 5 is a fragmentary elevational view from the inside of the housing, with a portion in vertical section, showing the door and alternative locking means for the door;

FIG. 6 is an enlarged elevational view of the lock of FIG. 5;

FIG. 7 is an enlarged elevational view of the lock of FIG. 5, but viewed from a direction perpendicular to that of FIG. 5;

FIG. 8 is a plan view of the projecting arm described above, which is carried by the closure; and FIG. 9 is a detailed elevational view of the projecting arm of FIG. 8.

DETAILED DESCRIPTION OF THE ILLUSTRATIVE EMBODIMENT

Referring to FIG. 1, an arcade game 10 is shown therein comprising a housing 12 having a front 14, sides 16, 17 and a rear (not shown) which typically faces a wall when the game is installed and being played. In the illustrative embodiment, arcade game 10 comprises a coin-operated video game having a video display 18, a control panel 20 carried by housing 12, and coin-receiving means 22, 23.

Coin-receiving means 22, 23 may be a conventional type in which a coin mechanism 22 is connected to a closure 24 which is hingedly connected to the housing to cover an access opening 26. A coin box 23 is located inside the housing so that coins which pass through coin mechanism 22 will fall into the coin box 23.

As illustrated in FIGS. 1 and 3, closure 24 is on the front 14 of housing 12 and presents coin slots 28 and 29 which communicate with coin mechanism 22. Closure 24 has a lock 30 for locking the closure to the housing and a coin return rod 32 for engaging coin mechanism 22 when a coin is stuck.

The electronic circuitry for controlling the arcade game, including various circuit boards and the power supply, are carried by a sliding panel 36. An opening 38 (FIG. 2) is defined by front 14. Within the interior of the housing 12, adjacent opening 38, are fixed tracks 40, 42, which permit sliding movement of panel 36 in and out of opening 38. Commercially available drawer slide tracks or the like may be used.

Opening 38 is closed, when desired, by a door 44 which has a periphery that matches the wall which defines the opening 38. Door 44 is connected to the front 14 of housing 11 by hinge or hinges 46 (FIG. 4). When panel 36 is slid into the housing, door 44 can be closed and the front surface of door 44 will be flush with the front surface of front 14 of housing 12. With door 44 being painted the same color as front 14, once it is closed it will be hardly noticeable.

It is important that unauthorized persons not have access to the electronic circuitry that is internal to the arcade game. To this end, locking means for door 44 are provided which are accessible only from inside of the housing. To this end, in order to unlock door 44, so that door 44 can be swung open to obtain access to sliding panel 36, closure 24 must first be unlocked and opened.

Referring to FIG. 2, it is seen that when closure 24 is open, access is provided to a handle 50. Referring now to FIGS. 3 and 4, it can be seen that handle 50 has a pin 52 which pivotally connects it to front 14 and also pins 54 and 56 which pivotally connect the handle, respectively, to rods 58 and 60. Rods 58 and 60 are pivotally connected by pins 62 and 64, respectively, to link members 66 and 68, respectively. Pins 70 and 72 pivotally connect link members 66 and 68, respectively, to front 14.

Door 44 carries a pair of spaced locking members 76, 78, each of which is fastened at one end to door 44 and has an open other end. As illustrated in full lines in FIG. 4, when handle 50 is in its upward position, links 66 and 68 extend into locking members 76 and 78 to lock door 44 with respect to front 14. However, when handle 50 is pulled downwardly to the position shown in dashed lines in FIG. 4, the linkage operates to remove link members 66 and 68 from locking members 76 and 78, thus enabling the door 44 to be pushed outwardly from the inside.

Once door 44 has been pushed outwardly to the position illustrated in FIG. 2, sliding panel 36 may be easily manually grasped by extending the fingers into finger slot 80 and pulling the sliding panel 36 along tracks 40, 42. When the circuitry has been serviced, the sliding panel may be pushed back into slot 38, door 44 then can be swung closed, and handle 50 can be moved upwardly to extend link members 66 and 68 into locking position with respect to locking members 76 and 78.

Following this, closure 24 may be closed and locked, preventing access into the interior of arcade game 10 by those who do not have a key to lock 30.

As particularly shown in FIG. 2, closure 24 may carry a projecting arm 81, conventionally secured thereto by rivets or the like through flange 83 and projecting inwardly from closure 24 to the interior of housing 12.

Projecting arm 81 may carry a hook member 82 at its free end to engage an inner surface, such as that of front wall 14 of the housing, to limit the angular extent of opening of the closure 24. As specifically shown, closure 24 cannot normally be opened to more than a 90° angle relative to front wall 14. This protects sliding panel 36 when it is in its access position, insuring that closure 24 will not strike any of the electronic components carried on sliding panel 36.

In other circumstances, it may be desirable to open closure 24 to a fuller extent than 90°, for example to remove and empty the coin container or for other access to the interior of housing 12. To facilitate this, projecting arm 80 may have a flexible portion 84, which may be a place of thin spring steel bolted or riveted to thicker portions 86 of projecting arm 80, so that arm 81 is generally stiff in normal operation, but may be manually flexed, as indicated in phantom lines in FIG. 2, so that closure 24 may be opened to a full extent of substantially 180°, when desired, by disengagement of arm 80 from wall 14.

Referring to FIGS. 5 through 7, a variation in the design of door locking means is disclosed, as a replacement for handle 50, rods 58, 60, and related parts.

In this alternative embodiment, door **44*a*, similar in design to door 44, is shown to be closed by a pivoted latch member 90 which moves about pivot 91 to a second, open position as shown in phantom lines. Spring 93 is provided to normally bias latch member 90 into its first, generally vertical position in which locking link 94 may be positioned between door 44*a* and metal strip 96 which may be bolted or riveted to door 44*a*, but spaced therefrom at its center to provide a retaining slot 94 for receiving locking link 94, for latching of door 44*a***.

Accordingly, closure **24*a*, of similar design to closure 24, may be unlocked and opened, and the handle 98 of latch member 90 may be gripped and moved into its horizontal position, opening door 44*a*. Since latch member 90 is spring biased to its first latching position, locking link 94 will normally interfere with the reclosing of door 44*a* unless one positively grips latch member 90 and pushes it to the horizontal position, to close the door and thus securely latch it. This serves as a safety measure to positively remind the service man that door 44*a* must be positively latched after closing, because otherwise the door cannot be closed at all. Thus the security of the interior of arcade game 10** can be maintained.

Handle 98 is shown by FIG. 7 to angle outwardly at an angle from door **44*a* for ease of gripping. Because of the outward divergence of handle 98 in latch member 90, latch member 90 can be inexpensively and conveniently made from a single metal stamping, and yet can still be easily grasped by a hand reaching through closure 24*a***.

Front wall **14*a*, sliding panel 36*a*, and sliding tracks 40*a*, 42*a***, along with the remaining parts of the device, may be of the design previously described.

It is seen that an arcade game housing has been provided which is simple in construction and enables superior access to the internal electronic circuitry, while at the same time prevents unauthorized access to the circuitry. Although illustrative embodiments of the invention have been shown and described, it is to be understood that various modifications and substitutions may be made by those skilled in the art without departing from the novel spirit and scope of the present invention.

What is claimed is:

1. An arcade game having an upright housing carrying a control panel, the upright housing enclosing electronic circuitry for the game, the upright housing having a rear side that typically faces a wall when the game is installed and played, the improvement comprising:

the upright housing defining an opening on a portion thereof other than its rear side;

a sliding panel carrying said electronic circuitry;

means connecting the panel for sliding cooperation with the upright housing whereby the panel extends outside of the housing in an access position and the sliding panel is slid into the housing in a normal game-play position;

a door for covering said opening;

means connecting the door to the housing and permitting the door to be located in an open position when the panel is in the access position and permitting the door to be located in a closed position, covering said opening, when the panel is in the normal game-play position; coin-receiving means carried by the housing, the housing defining an access opening for the coin-receiving means;

a closure for covering said access opening;

means for locking said closure closed to prevent access to the coin-receiving means; and means for locking said door, said door locking means being inaccessible when said closure is locked closed, said door locking means comprising a linkage interconnecting the housing and the door; and means for operating said linkage to enable opening of the door only when the closure is unlocked.

2. An arcade game as described in claim 1, wherein said opening is defined on the front side of the upright housing.

3. An arcade game as described in claim 1, said connecting means comprising a pair of fixed tracks extending into the housing for enabling the sliding panel to slide along the fixed tracks into and out of the housing.

4. An arcade game as described in claim 1, said sliding panel having grasping means for enabling simple manual grasping of said panel, said panel having a form that is generally planar and extends generally perpendicular to the plane of the portion which defines said opening.

5. An arcade game as described in claim 1, said door locking means comprising a member fastened to the rear of the door and having a portion spaced from the door, a locking link coupled to the housing and being movable (a) into a position between said spaced portion and said door to lock the door with respect to the housing and (b) away from said spaced portion to unlock the door with respect to the housing.

6. An arcade game as described in claim 5, said locking link being pivotable through a rod that is pivotally connected to said locking link, and a handle that is pivotally connected to said rod.

7. An arcade game as described in claim 6, said locking link and handle each being pivotally connected to said housing.

8. An arcade game as described in claim 5 in which said locking link is directly attached to a handle to form a latch member, said latch member being pivotally attached to said housing to move said locking link into and away from engagement with the spaced portion, said latch member being spring-biased into a position in which the locking link is positioned to engage a retaining slot defined between the door and spaced portion, whereby said door, after opening, cannot be closed without properly relatching the door with the latch member.

9. The arcade game of claim 1 in which said closure carries a projecting arm extending into said housing and defining a hook member at its inner free end to engage an inner surface of said housing, to limit the angular extent of opening of the closure.

10. An arcade game as described in claim 9 in which said projecting arm may have a flexible portion positioned between its ends, to permit one to manually disengage the hook member from the inner surface of the housing when it is desired to open the closure to a full extent.

11. An arcade game having an upright housing carrying a control panel, the upright housing enclosing electronic circuitry for the game, the upright housing having a rear side that typically faces a wall when the game is installed and played, the improvement comprising:

the upright housing defining an opening on its front side;

a sliding panel carrying said electronic circuitry;

means connecting the panel for sliding cooperation with the upright housing whereby the panel extends outside of the housing in an access position and the sliding panel is slid into the housing in a normal game-play position;

said connecting means comprising a pair of fixed tracks extending into the housing for enabling the sliding panel to slide along the fixed tracks into and out of the housing;

said sliding panel having grasping means for enabling simple manual grasping of said panel;

said sliding panel having a form that is generally planar and extends generally perpendicular to the plane of the front portion of the housing;

a door for covering said opening;

means connecting the door to the housing and permitting the door to be located in an open position when the panel is in the access position and permitting the door to be located in a closed position, covering said opening, when the panel is in the normal game-play position;

coin-receiving means carried by the housing, the housing defining an access opening for the coin-receiving means;

a closure for covering said access opening;

means for locking said closure closed to prevent access to the coin-receiving means; and means for locking said door, said door locking means being inaccessible when said closure is locked closed, said door locking means comprising a linkage interconnecting the housing and the door; and means for operating said linkage to enable opening of the door only when the closure is unlocked.

12. The arcade game of claim 11 in which said closure carries a projecting arm extending into said housing and defining a hook member at its inner free end to engage an inner surface of said housing, to limit the angular extent of opening of the closure.

13. An arcade game as described in claim 12 in which said projecting arm may have a flexible portion positioned between its ends, to permit one to manually disengage the hook member from the inner surface of the housing when it is desired to open the closure to a full extent.

* * * * *

UNITED STATES PATENT AND TRADEMARK OFFICE

CERTIFICATE OF CORRECTION

PATENT NO. : 4,397,509

DATED : August 9, 1983

INVENTOR(S) : Anthony J. Miller et al.

It is certified that error appears in the above-identified patent and that said Letters Patent is hereby corrected as shown below:

The title page showing the illustrative figure should be deleted to appear as per attached page.

Signed and Sealed this

*Eleventh* Day of *October 1983*

[SEAL]

*Attest:*

GERALD J. MOSSINGHOFF

*Attesting Officer*

*Commissioner of Patents and Trademarks*

United States Patent [19]
Miller et al.
[11] 4,397,509
[45] Aug. 9, 1983

[54] ARCADE GAME HOUSING

[75] Inventors: Anthony J. Miller, Skokie; Brian L. Poklacki, Chicago, both of Ill.

[73] Assignee: Universal Research Laboratories, Incorporated, Elk Grove Village, Ill.

[21] Appl. No.: 247,729

[22] Filed: Mar. 26, 1981

[51] Int. Cl.³ ..... A47B 63/00; E05B 65/46

[52] U.S. Cl. ..... 312/320; 312/217; 312/223; 312/311

[58] Field of Search ..... 312/320, 223, 311, 217, 312/220, 221, 222, 35, 204; 211/26; 248/551, 552, 553; 194/1 A

[56] References Cited

U.S. PATENT DOCUMENTS

| | | | |
|---|---|---|---|
| 965,253 | 7/1910 | Tate | 312/217 |
| 1,750,291 | 3/1930 | Whetstone | 312/311 |
| 1,754,527 | 4/1930 | Rowe . | |
| 2,608,305 | 8/1952 | Sager | 312/311 |
| 2,660,506 | 11/1953 | Wright | 312/311 |
| 2,951,185 | 8/1960 | Buck | 312/320 |
| 3,135,570 | 6/1964 | Erismann | 312/311 |
| 3,137,533 | 6/1964 | Acker | 312/35 |
| 3,998,508 | 12/1976 | Scheerhorn | 312/217 |
| 4,002,381 | 1/1977 | Wagner et al. | 312/320 |
| 4,175,672 | 11/1979 | Moser . | |
| 4,209,211 | 6/1980 | Alford | 312/35 |
| 4,245,871 | 1/1981 | Rex | 312/223 |

FOREIGN PATENT DOCUMENTS 699842 11/1953 United Kingdom ..... 312/217

OTHER PUBLICATIONS

Defensive Publication T174767, vol. 671, O.G. 1498, Jun. 30, 1953.

*Primary Examiner*—Victor N. Sakran
*Attorney, Agent, or Firm*—George H. Gerstman

[57] ABSTRACT

An arcade game in which the housing defines an opening on the front portion of the housing. A sliding panel which carries electronic circuitry is slid into and out of the housing, through the opening, along tracks. The front of the housing has a door for covering the opening, but this door is normally locked and can be unlocked only from inside the housing. To obtain access to unlock the door, the coin box closure on the front of the housing must be unlocked, enabling the operator to extend his hand into the interior of the housing to unlock the door.

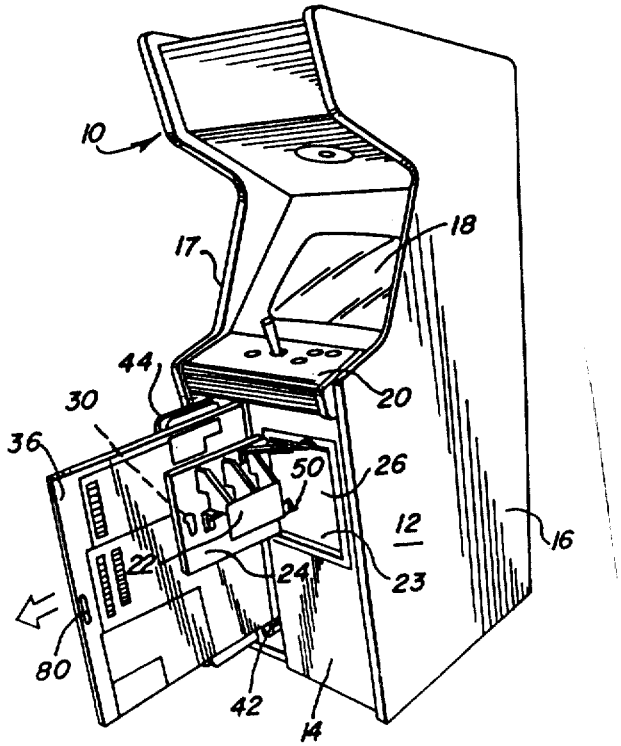

13 Claims, 9 Drawing Figures